US006762686B1

(12) United States Patent
Tabe

(10) Patent No.: US 6,762,686 B1
(45) Date of Patent: Jul. 13, 2004

(54) INTERACTIVE WIRELESS HOME SECURITY DETECTORS

(76) Inventor: Joseph A. Tabe, 525 Thayer Ave., Apt. 315, Silver Spring, MD (US) 20910

( * ) Notice: Subject to any disclaimer, the term of this patent is extended or adjusted under 35 U.S.C. 154(b) by 0 days.

(21) Appl. No.: 10/150,155

(22) Filed: May 20, 2002

Related U.S. Application Data

(63) Continuation-in-part of application No. 09/577,383, filed on May 23, 2000, now abandoned.
(60) Provisional application No. 60/135,352, filed on May 21, 1999.

(51) Int. Cl.[7] ..... G08B 23/00
(52) U.S. Cl. ..... 340/573.1; 340/545.3; 340/541; 340/565; 340/628; 379/40; 379/43; 379/44
(58) Field of Search ..... 340/573.1, 541, 340/545.3, 565, 628, 629; 379/37, 40, 43, 44

(56) References Cited

U.S. PATENT DOCUMENTS 4,737,770 A * 4/1988 Brunius et al. ..... 340/539.22
4,857,912 A * 8/1989 Everett, Jr. et al. ..... 340/508
5,319,698 A * 6/1994 Glidewell et al. ..... 379/39
5,438,607 A * 8/1995 Przygoda, Jr. et al. ..... 379/38
5,486,810 A * 1/1996 Schwarz ..... 340/521
5,971,597 A * 10/1999 Baldwin et al. ..... 700/277
6,114,948 A * 9/2000 Astell ..... 340/332
6,583,720 B1 * 6/2003 Quigley ..... 340/521

* cited by examiner

*Primary Examiner*—Toan Pham
(74) *Attorney, Agent, or Firm*—Krieg DeVault Lundy LLP

(57) ABSTRACT

The wireless home security detector monitors fire, smoke, and home security to protect the home. The wireless home security detector dials the proper authorities in the event of an emergency. An alarm will come on in seconds after the smoke or fire is detected. When the fire alarm is activated, it will emit a special code that will activate the passive infrared motion detector that will check for any body heat inside the home. If body heat is detected, the infrared motion detector will activate an alarm responsive to detecting the location of a person; and include a human voice response. This alarm will keep sounding if body heat is detected and it will also monitor the body heat location as the person moves from one room to the other. The motion detector will stay on in the occupied room as an indication that a person has been located inside the room, to aid authorities in an emergency. A programmable microprocessor is used for receiving, storing and processing data from the interactive detectors, the interactive alarms and the human body sensors, and a reporter is used to transmit sensed alarm activities to selected proper authorities in the presence of an emergency.

20 Claims, 5 Drawing Sheets

INTERACTIVE WIRELESS HOME SECURITY DETECTORS

RELATED APPLICATION

This application is a continuation-in-part of patent application Ser. No. 09/577,383, filed May 23, 2000 now abandoned; which claims benefit of U.S. provisional patent application No. 60/135,352 filed May 21, 1999, entitled SUPPLEMENTAL HOME INTERACTIVE SECURITY DETECTORS, By Joseph A. Tabe, which are incorporated by reference herein.

FIELD OF THE INVENTION

The present invention is directed to an interactive wireless home security system, utilizing wireless interactive programmable detectors to provide direct wireless communication to the police department and/or the fire department, when a dangerous condition is sensed.

BACKGROUND OF THE INVENTION

Each year thousands of people die horrible deaths from fires in America. Eighty percent of these fires are residential fires. When undetected, these fires may lead to serious injury or death. Current home security devices are intended to get the attention of the occupants inside the home.

Burglary and fire hazard accidents are the leading cause of death in the US. Monitoring stations are sometimes used to monitor a home when the occupants are away. These monitoring stations are expensive, The government has made it a law that all businesses have fire extinguishers and many other fire protection devices. But homes are not tied to this law. Most fires start from residential areas. More civilian deaths are from fire rather than car accidents. Yet, more emphasis is placed on car safety, than on home safety. It is far more expensive to repair damages caused by fire than it is to repair damages caused by car accidents.

Fire often occurs in places that are not easily noticed during the initial phase, when the fire is most easily controlled. The sooner a fire or burglar is detected, the more quickly the fire or police department can respond.

Statistics show that a burglary is committed some where in America every ten seconds. Only 16.5% of U.S homes have burglar alarms. The burglary rate in neighboring geographical areas often varies according to the residents age and lifestyles, the proximity to high crime areas, zoning regulations, and land use. The burglar is sometimes equipped to kill. Thus knowledge of the location of the burglar is essential to quick apprehension.

SUMMARY OF THE INVENTION

The interactive wireless home security detector disclosed herein, is designed to protect homes from burglary, fire, smoke, carbon monoxide poisoning, and forced entry. In an emergency, the interactive wireless home security detector is programmed to call the Police, Fire department, relatives, and/or the homeowner's office or cell phones. The wireless home security detector communicates with other detectors when activated, and an alarm for the detected activity is enabled to alert the environment about such activity. The activated alarm will enable an inferred detector, which will emit rays to detect the presence of human body temperature in the area of the alarm. When a human body temperature is sensed, the alarm will stay on, to identify the location of the person. If the person moves from room to room, the alarm will follow the movement of the person to aid in locating the person. The interactive security alarm system is self monitoring, and designed to monitor all activities in the home, using digital wireless and line communication and a sensing means to transfer data from homes directly to the proper authorities. Detectors take pictures of any unauthorized entry, and broadcast a human voice response in addition to notifying authorities. Signs may be used to warn an unauthorized person of the presence of the security device.

The interactive system is programmable and monitors the entire house. Radio wave signals and/or microwave signals are used to communicate an alarm condition to the authorities. The microprocessor and sensors are installed in the system to allow the systems to communicate and recognize the unique identification codes of each sensor. A control panel touch pad is used to program the interactive security detectors. Batteries are used to energize the remote sensors. The receiver uses redundant, spatially diverse antennas that virtually eliminate the chance of missing signals. The interactive detecting system also uses phone lines and radio transmissions to send signals to the proper authorities. The reporter has a built in energy storage capacity that will allow it to communicate with the proper authorities, even if the home power is out. The sensors pick up signals when activated, and emit a radiant code that is energized by the radio waves or microwaves and absorbed by other sensors in the house. The radio frequency of the signals varies during use, to improve reliability.

The sensors are programmed with a unique identification code so that no two sensors within the range of the control panel have the same identity. A built in microprocessor controls intelligence, and includes sophisticated decoding capabilities that won't allow signals from the wrong sensor to trip the alarm. The wireless security system won't communicate with another wireless device such as cordless phone unless they are coded to communicate to each other. The system uses two antennas with "spatial diversity" for receiving signals.

In the learn mode, the reporter will automatically program each function introduced to it. Sensors can be added or deleted from the system to meet the need for an improved home security system.

Wireless sensors, when activated, will allow communication between the sensor and the reporter. The sensors have two basic functions; the first is to detect a change of state, and the second is to communicate or send a message about the change of state to various authorities. The messages sent by the interactive security detectors are very specific and are sent to selected receivers. The receivers include other motion detectors and fire alarms, and also include messages to the proper authorities. This system encodes information by modulating an electromagnetic wave, which radiates out in all directions from the transmitter's antenna. Battery power empowers the transmitter antenna, and allows the sensors to propagate through space to reach the receiver antenna.

The interactive detecting device uses radio waves and/or microwaves as the communication medium, which is intended to incorporate human voice into the transmitted messages. When the coded signal reaches the receiver antenna, the receiver will then interpret and decode the received information, translate it into a message that is indicative of the danger, and passes the information and the location of the sensor through the reporter to the authorities, whether it is an intrusion, fire, medical, or environmental sensor.

The emitting code for each sensor is different. The sensors are programmed with unique coded sensor numbers, to avoid false activation.

The transmitter consists of a radio frequency oscillator that will generate the carrier frequency and also modulates to impose the message into the carrier frequency while the antenna emits or radiates the signal. The sensor will detect the environmental changes and also allows the transmitter to communicate these changes to the proper authorities.

An automatic controller controls the different signals transmitted from a burglar entering the home, or the existence of fire inside the home. The controller has a diode that is used for diffusion to allow the controlled circuit to be integrated. The semiconductor, which draws very little current from the battery, allows the free electrons to be drawn towards the positive potentials, permitting the resulting movement of the electron to drift each time there is a detection.

When smoke is detected, the charge carrier will repel each other from the areas of higher concentration to lower concentration to allow for a precise detection of the location of a fire. The low current will flow when sensing an intruder due to diffusion, to activate the alarm even without an applied voltage. Due to the diffusion, a potential difference will develop as the detector is activated. Since the receiver is programmed to only hear certain codes, false alarms will not be caused by radio signals from sources like garage doors or TV remote control, or airplanes passing overhead. The stay mode will allow the system to be on, but the occupants can move inside the protected area without setting the alarms off. When in the away mode, all the interior and exterior sensors will be on. With the no delay mode, the device will immediately be activated when any of the doors or windows are opened. When the perimeter detector is on, normal activities can continue inside the home, as long as the exterior openings are not opened. The device will provide optimum protection against loss of valuable property and home due to fire or burglar, by providing early warning to the various stations and inhabitants. All the various types of smoke detectors will emit a suitable code when activated.

An Ionization smoke detector is designed to protect particles of combustion, and the photoelectric smoke detectors generate a beam of light, which also detects cool smoke from mattresses or sofas when ignited by cigarettes.

Poisonous gasses can knock out inhabitants within three minutes or less when there is fire. If some one is knocked out, the passive infrared motion detector will pin point the exact location of the victim and make it possible for the fire department to rescue the said person. A pyro-sensor can also be used to sense body heat when monitoring a trapped person in case of fire or to sense the location of an intruder. An Ionization smoke sensors will detect particles of combustion. The Ionization smoke detector will provide a faster response to an open flame fire, Where as a photoelectric smoke sensor will generate beam of lights and if the beam is broken, an alarm will then be activated. This sensor detects cool smoke that is produced by cigarette burnt mattresses and sofas. This kind of smoke also contains carbon monoxide and can kill sleeping occupants before setting off the Ionization smoke detector. The present invention allows the detectors to network and stay interactive with other detectors in the home, including wireless phones and the like. The passive infrared sensors will count pulses from any fire alarm sensors and allow adjustment of its sensitivity to detecting any body heat that is trapped in the smoke. The glass mounted circuitry will analyze and detect the frequency of breaking glasses and communicates the exact location of the intruder by sensing body heat. The reporter has a systems console that acts as the brain of the interactive security detectors. The reporter listens for transmissions from sensors and activates the appropriate dialing code. With the smoke detector, the motion detector, and other detectors interacting, the burglar will know that he has been discovered and will not stay long in the home. The reporter will dial the police without the burglar knowing, and his body heat will always be monitored should the intruder try to hide. A perimeter alarm will sound before the intruder enters the house. If area alarms are installed in every room of the house, then entry will be detected as soon as it occurs. The interactive security detector uses radio waves, microwaves, or ultrasonic signals to detect any movement in the house and also to communicate to the reporter. The motion detector will detect motions by sending out signals and then it will analyze the signal that is reflected back by objects in the room. The signal operates on the same basic principles as radar or sonar detectors.

The interactive security detector will also discriminate against random motion that is created by winds or heating or cooling systems, and will set off when motion is progressive and not random. The passive infrared detector will respond to a heat source in the 98-degree Fahrenheit range, which correspond to the temperature of the human body. This will detect a person trapped in fire or smoke. The motion detector must progress across several detectors before the alarm is sounded. A sound detector looks for a certain amount of sound from breaking glasses, cracking wood, hammering on the lock, etc. Passive infrared (PIR) motion sensors, which work by detecting body heat inside and around the house, are adjusted to work on broad or narrow spaces. Motion sensors can also be aimed and masked to prevent a false alarm caused by pets, heat vents, and objects in the house. All the sensors are designed to network with each other. The sound sensors are design to hear specific frequencies such as those made by breaking glasses. The smoke sensor will detect smoke and sound an alarm. Radiant energy from the alarm will activate the infrared motion detector that will then monitor any body heat within a room. The smoke alarm will send a programmable fire alarm code from the electronic microprocessor to the microprocessor receiver. The infrared motion detector, upon receiving said code, will then be activated to monitor any body heat in each room. The rate of rise sensor which is used to detect sharp increase in temperature in areas where smoke or high temperature might occur naturally, such as the kitchen, furnace room, and garages. The home interactive security detectors can also control a freeze sensor, to detect ambient temperature drops, before serious damage occurs.

A wireless touch pad allows the user to control the interactive security detectors without having to go to any control panel or company control station. A speaker is built into the interactive security detector for human voice response. The touch pad can be coded to allow access to other systems, or to prevent unauthorized persons, or very young children, from operating the system. The homeowner can program the interactive device to increase or reduce the amount of security on the premises.

The burglar alarm and the fire alarm may be incorporated into a single housing to share electronic components and save cost.

The reporter contains a control panel and provides a central location where all unsafe activities are sent for immediate reporting. It contains the necessary circuits to analyze the emitted data from the detectors and also to communicate to the authorities. The reporter contains a terminal block for sensing devices, a relay to activate the communicator or dialing code, and the power supply to energize the system, and the microprocessor that analyzes all data received from the sensing devices before the law enforcement stations are properly informed.

The reporter also has an AutoDial that calls the police or fire department when the alarm is tripped. It may also be linked to direct phone wiring in a hard wiring system, or linked to the panel by radio in a wireless system. The reporter also has a battery back up which protects the interactive security detector against a power black out that can leave monitored homes unprotected. The battery is connected to the power supply to charge the battery to provide full energy when needed or as back ups during black outs. The reporter is preferably enclosed in a tamper proof enclosure to avoid easy access.

The motion detector will stop its alarm signal approximately two minutes after the burglar is no longer detected or when the fire temperature or smoke has been taken cared of. The microprocessor for the reporter will call a predetermined phone number each time any of the detectors are activated, with a standard vocal recording that would give a complete address of the home in question, whether it is a burglar or a fire based on the radiated code.

DETAILED DESCRIPTION OF THE PREFERRED EMBODIMENT

Figure 1:
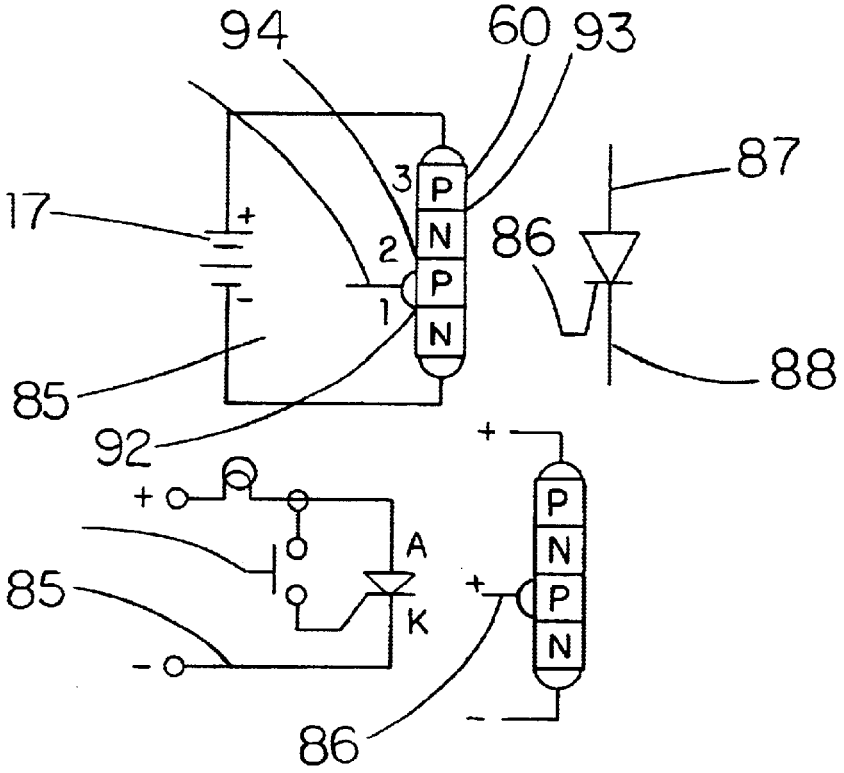
FIG. 1. is a block diagram and symbol for a silicon control rectifier and a SCR switching circuit for the detectors.
Figure 2A:
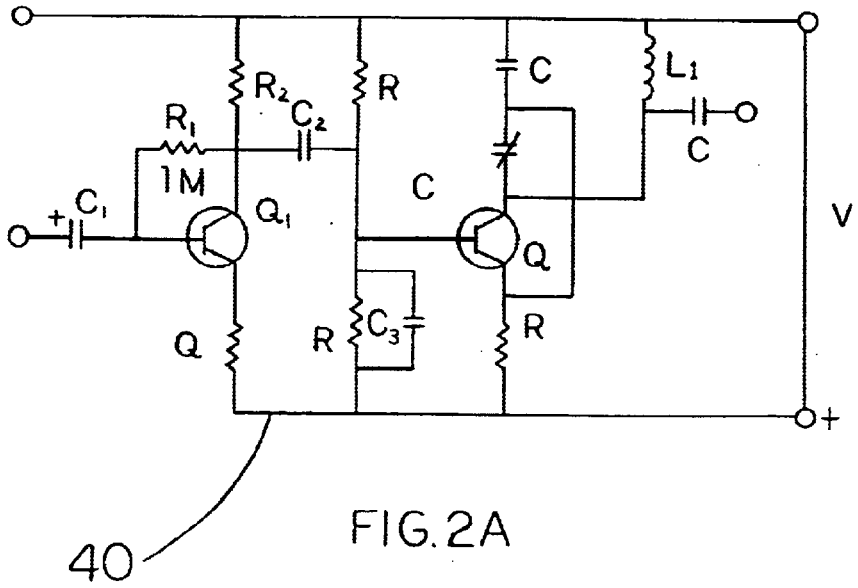
FIG. 2A is a diagram showing the transmitter circuit for transmitting SHSID coded signals.
Figure 2B:
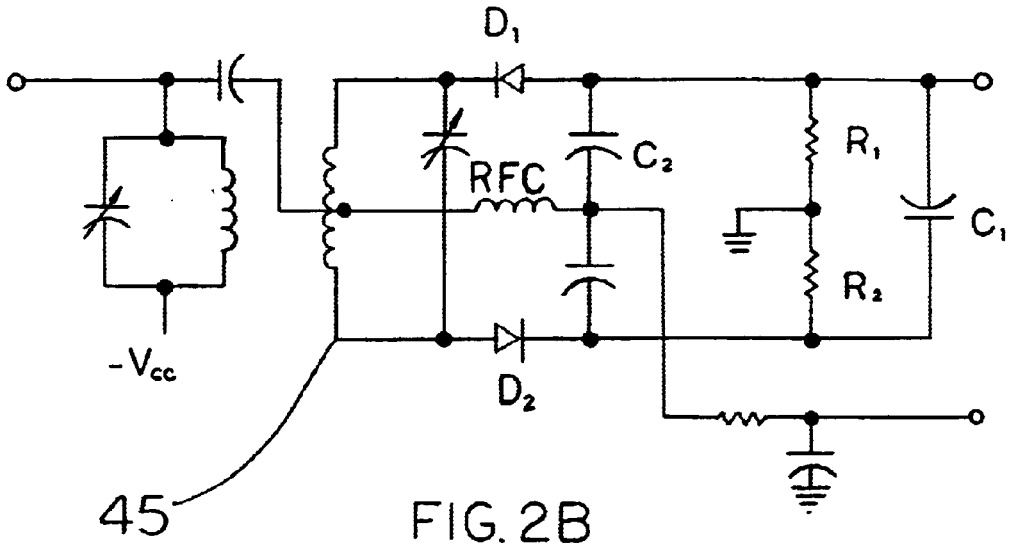
FIG. 2B is a diagram showing the receiver circuit for receiving SHSID coded signals.
Figure 3:
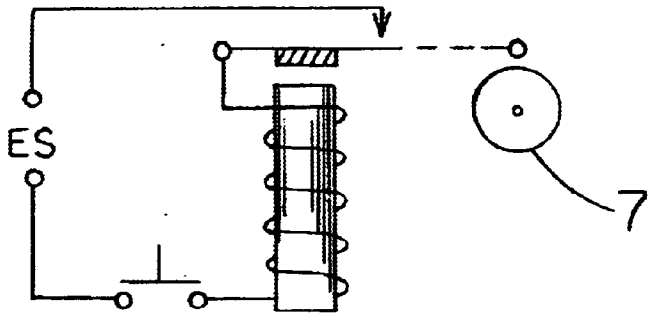
FIG. 3. is a diagram showing the circuit for the alarm buzzer.
Figure 4:
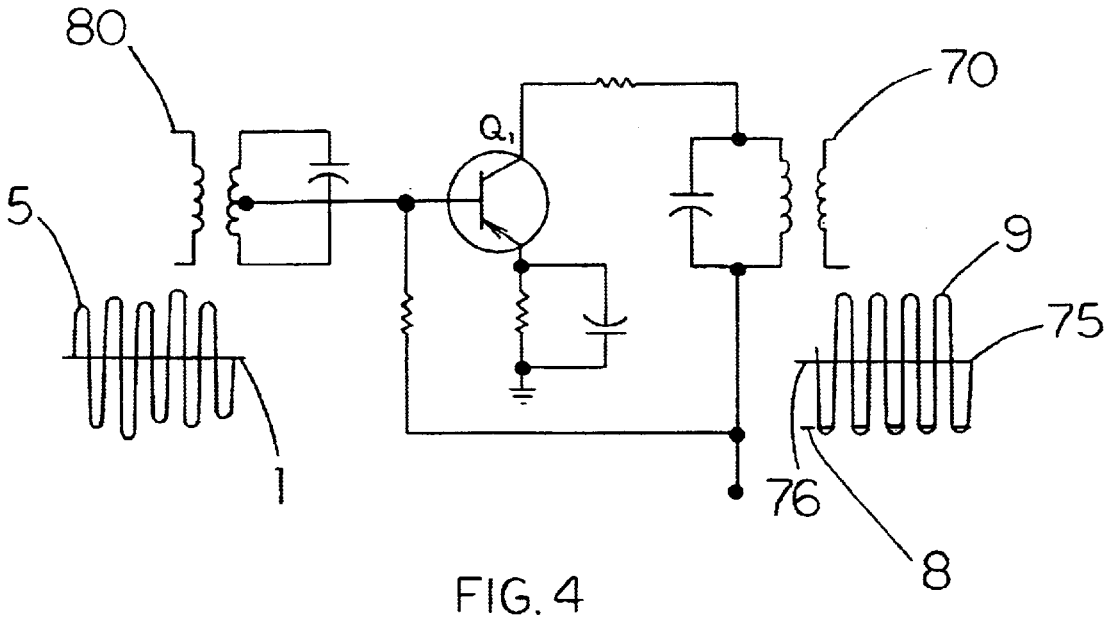
FIG. 4. is a diagram of the discriminator circuit.

The present invention is a wireless interactive security detector apparatus 4 designed to network and interact with other detectors in a house or home 5. The wireless interactive security detector apparatus 4 is controlled by a programmable microprocessor 100 and a controller 85, such as a Silicon Control Rectifier (SCR). The wireless interactive security detector apparatus 4 is designed to reduce a homeowner's chance of being victimized, by utilizing a human voice warning 16, and a photocell 24 to take pictures of any unauthorized entering, and immediately dial the proper authorities 35, such as the police or fire departments 36, 37. However, the interactive security detector apparatus 4 will detect an intrusion or coded signal 9 at any point of entering into the home 5 when programmed, and activate the programmable reporter 50 in response to an unauthorized intrusion.

The detector is configured as an interactive detector 10 with at least one programmable microprocessor 100 and a SCR 85. The microprocessor 100 and the SCR 85 are the basis for coordinating the interactions between programmable detector 10 for home security, which operates in circumstances that are deemed unsafe for homeowners.

Transmitters 40 and receivers 45 or transceivers 46 are used, with a programmable reporter 50 that includes an external touch pad 31 and keypad 30 to input programming for the interactive detectors 10, to enable and interact with other detectors and the programmable reporter 50. The programmable reporter 50 receives coded signals from the interactive detectors 10, and selectively dials the proper authorities 35 for rescue.

The interactive detectors 10 may be different detectors, but each are electronically controlled by the programmable microprocessor 100, the SCR 85, the transmitters 40, and the receivers 45, to report all unsafe activities within the home 5, to the programmable reporter 50. The programmable reporter 50 is selected to be a hard wired telephone connection 52 or a wireless phone communication means 54, to enhance the ability to communicate with said interactive detectors 10 in dangerous, or unsafe situations.

The programmable reporter 50 will then wirelessly communicate with the proper authorities 35, such as the fire department 37 and the police department 36 for immediate assistance. Batteries are preferably provided to provide power to the transmitter 40 in the event of a power failure.

Interactive detectors 10 provide direct communication with the proper authorities 35, to further enable the proper authorities 35 to come to the homeowner's rescue. The programmable reporter 50 and the microprocessor 100 has the configured ability and capability to accommodate various types of signals and software with different hardware configurations, without allowing the hardware to disrupt the intelligence of the interactive security detector apparatus 4. The microprocessor 100, the SCR 85, the transmitter 40, and the programmable reporter 50 deliver data processing capabilities through wireless communication means 54 within the home 5. Said communication means 54 is transmitted through radio waves 75 or microwaves 76, to their programmed destinations for fast response.

Researchers have proven that burglaries and fire hazards are the leading cause of deaths in the US. Still, homeowners are constantly wondering on how to safely protect their homes 5 from these dual perils in order to further protect the lives of their families and love ones. However, in order to achieve maximum security in the home (5), homeowners need to install detectors 10 in various sensitive entrances into their home 5. Since all detectors 10 work basically on the same concept, only the passive infrared PIR motion detector 15 and the general smoke detector 20 are detailed in this embodiment. The concept behind interactive detectors 10 includes any known detector 10 used at home 5 to detect and protect the homeowners from different unsafe conditions.

Statistically, thousands of people die horribly deaths each year from fires in which 80% are residential fires. The present invention is designed to improve home safety in all categories. When people are trapped in their homes 5 because of fire 1 or smoke 2, the smoke 2 will interrupt the flow of current and the fire alarm 7 will then emit a radiant energy 8, or coded signal 9, that will be transmitted through the transmitter 40, to the PIR 15. The PIR 15 upon receiving the coded signal 9, will then be enabled to detect any body heat 25 from individuals that may be trapped in the home 5, due to existing fire 1 or smoke 2.

Understanding that most deaths are from fire (1), rather than car accidents, the present invention is intended to use the emitted radiant energy pulses 8, from the fire alarm 7, to interactively activate the PIR 15 and other detectors 10, so as to monitor any body heat 25, when fire 1 or smoke 2 is detected in the home 5.

The invention is intended to further advance home securities to better serve and protect homeowners. It can be very devastating to be involved in any fire 1 or extended smoke 2 situation. Therefore, the supplemental home interactive security detector apparatus 4 will protect homeowners when a family member is trapped by smoke 2 or fire 1, or subject to other dangers inside the home 5.

Since fire 1 occurs in places that are not easily noticed, the spread of the smoke 2 from the fire 1 is detected by the detector 10, that will enable activation of an alarm 7. The alarm 7 will then emit a coded signal 9, or radiant energy 8, to the PIR 15 to activate the programmable reporter 50, that will then dial the proper authorities 35 directly, without the extra expenses of paying private monitoring stations.

There are three types of fire detectors 10 that could be incorporated to interact with the other devices for the interactive security detector apparatus 4. There are; the heat sensor 11, the Ionization smoke detector 12, and the photoelectric smoke detector 13.

The heat sensor 11 will react to heat caused by fire 1 and should be placed close to the kitchen or furnace to give an early warning of the initial fire 1, and also communicates to the infrared motion detector 15 or the body heat sensor 25. Some fires 1 progress to an area where escape is difficult and the fire generates enough heat to set off distant heat sensors 11. These heat sensors 11 are best suited for installation around the kitchen, furnace, and water heater to warn of the possible ignition caused by the heat build up and would interact with the other detectors to monitor any trapped person in the home 5.

Ionization smoke detectors 12 use small radiant sources to detect the presence of ionized air or gas. When these elements are present, the alarm 7 will then come on and radiant energy 8 will be emitted to activate the infrared motion detector 15 to monitor any body heat 25 as an indication of a person trapped in the home 5. The Ionization smoke detector 12 will respond best to flame fires 1 and because a fire 1 may smolder for a long time before flaming, and an Ionization smoke detector 12 may not give adequate warning of this type of fire 1. Occupants may inhale much smoke 2, and be trapped inside. But by incorporating the detectors 10 to communicate to each other, it will be much faster to detect the location or area where a person is trapped, and thus speed the rescue effort.

A photoelectric smoke detector 13 has an infrared eye 26, which will look for smoke 2 in the air and immediately activate a response faster, since most people die from smoke inhalation when a fire 1 occurs. When the smoke 2 is detected, the area will be monitored to clear any person who may still be inside the home 5 at the time the smoke 2 is detected. The fire department will then have complete knowledge of the location of a person is inside the home, as the infrared motion detector 15 or the body heat sensor 25 continues to output an alarm. The photoelectric smoke detector 13 will detect smoldering fire 1 before it flames and before it generates enough heat to set off the heat sensor 11.

All the detectors 10 are preferably interactive and allow other detectors 10 to monitor for any trapped person while the reporter 50 calls for the trained personnel to come to the rescue of any trapped person. Experience has proven that most home fires 1 begin as smoldering fire, therefore the photoelectric smokedetector 13 is recommended for the general use in homes to keep track of any smoldering fire 1. But any sensed information would have to be reported immediately to the fire department 37 so that further damages would be minimized and many lives saved.

The invention further provides full security powers in the home 5, without requiring the use of any monitoring station (not shown). An improved wireless key pad 30 or touch pad 31, and a programmable reporter 50 control the interactive security detector 4 by entering codes 32 through the key pad 30 or the touch pad 31 to selectively enable or disable security through the reporter 50.

All the activities are reported to the proper authorities 35, such as police 36 or fire departments 37, from the coded input 32 through the programmable reporter 50, to immediately summon a rescue. When a burglar is detected in the perimeter of the home 5 or inside the home 5, the PIR 15 will sense the body heat 25 and optically picture 33 the burglar through the photocell 24, and the LED 23, to further produce a complete description of the burglar.

The eye of the photocell 24 is incorporated in the infrared eye 26 and is powered and controlled by the reporter 50. The spread of smoke 2 will activate the smoke detector 20 that will then activate the PIR 15. The PIR 15, upon receiving the emitted code 32 from the smoke detector 20, will activate the reporter 50 to dial the fire department 37 or police station 36 for immediate response, to aid the occupants and also reduce the damages inside the home 5. Labels or signs 78 are distributed around the home 5 to warn burglars and intruders of the protection around the home 5. The interactive security detector sign 78, will often scare burglars away. If the burglar ignores the sign 78 and proceeds break in, the eye of the photocell 24 will take pictures 33 of the intruder while the PIR 15 will sense the intruder's body heat 25 and activate the alarm 7. This will then emit a coded signal 9, or radiant energy 8, that will activate the reporter 50. The reporter 50, after receiving the emitted signal 9, will then dial the police station 36 directly to further reduce the confrontation between the intruder and the homeowner. The said device when programmed will also monitor the activities inside the home 5. The discriminator 70 will prevent false activation of the interactive security detector 4, and when activated, the reporter 50 will call for the proper authorities 35 for their immediate response. The coded signal 9 and radiant pulses 8 will then travel through radio frequencies or microwave signals of sufficient strength to communicate to the proper authorities 35. All signals are transmitted through at least one of: radio waves 75, microwaves 76, or ultrasonic waves 77. When transmitting coded signals 9 and radiant pulses 8, a redundant or diverse antenna 79 is used to eliminate any unwanted signal. Signals are transmitted through phone lines or by wireless phone communication means 54 to the police station 36 or to other proper authorities 35. The reporter 50 has a built in transformer 80 and a battery power source 21 that will allow communication when there is any electrical blackout. The detector 10 picks coded signals 9 and radiant pulses 8 and stays in activation as the signals 8 and 9 are emitted through radiant codes 32 to energize the radiant waves and allow absorption by the other sensors in the home 5. When the fire alarm 7 is on, the impulse of the sound of the alarm will emit a radiant energy 8 that will then be powered by the radio waves 75 or microwaves 76 or ultrasonic waves 77. The energy will then be absorbed by the PIR 15, and if an occupant were trapped inside the home 5, the PIR 15 would then activate the reporter 50, by emitting a second radiant energy 8 to the reporter 50 that would immediately allow dialing of the proper authorities 35. The reporter 50, upon receiving the radiant energy 8, will dial the fire department 37 and/or the police department 36 for immediate assistance. The built in microprocessor 100 controls this device intelligence, to selectively not signal when a wrong sensor tries to trip the alarm. The electromagnetic waves 75, 76 will allow communication in the home 5, by working closely with the PIR detector. 15. When the smoke detector 20 is activated, communication is enabled. The smoke detector 20 will detect changes of state and send messages or signals 8, 9 about the change of state of the detectors to the various authorities 35 through the frequency energy waves 75, 76, or 77. All messages are sent to the receivers 35, 25, and 90.

The sent information is then encoded by modulating electromagnetic waves 75, 76, 77 which radiate out in all directions from the transmitter 40. The battery 21 power, which empowers the transmitter 40, will then allow the detectors 10 to send out at least one electromagnetic wave signal 75, 76, 77 that will propagate through space and reach the receiver 45.

The radio receiver 45, upon accepting the modulated signal 8, 9, will then interpret the meaning so that the surrounding environment is better understood and cleared of dangers. The receiver 45 after receiving and decoding information will then translate the information into a message that is indicative of the specific dangerous environment. The decoded information will then be passed on to the reporter 50, that will then dial the proper authorities 35. The signal from the transmitter 40 will send information about the transmitted signal.

The automatic controller 60 controls different signals that are transmitted from the fire alarm 7 or the motion alarm 6. The controller diode 65 allows the controller 60 circuitry to integrate. When smoke 2 is detected, the charge carrier will repel each other, allowing a precise detection of the location of the intruder or fire. When an intruder is sensed, the diffusion will cause the lower current to flow to activate the alarm 7 even without any applied voltage.

When the smoke detector 20 is activated, a potential difference will develop and the SCR 85 will serve as a closed circuit. When the smoke detector 20 is disabled, the SCR 85 will serve as an open circuit. The SCR 85 will receive all its instructions from the microprocessor 100. When there is no detection, the SCR 85 will block any applied voltage in either direction.

When a motion is sensed, the SCR 85 will then be enabled to conduct voltage in the forward direction and the signal will be applied to the gate electrode 86. The SCR 85 is forward biased with the positive lead of the voltage source connected to the anode 87 and the negative lead is connected to the cathode 88. Junction one 92 and Junction three 93 are forward biased and Junction two 94 is reversed biased. If a voltage pulse or current pulse is applied to the SCR 85, the forward bias will then conduct, allowing the SCR 85 to control the detecting signals.

When the SCR 85 is in conduction, the gate 86 will be of no consequence and the circuitry will continue to be in conduction regardless of the presence or lack of the gate 86 signal, until the forward current drops below a certain level, which will be indicative of no body heat. The SCR 85 will allow S1 to be open when it is not in conduction, or when the smoke detector 20 is disabled or in the normal mode.

When S1 is closed, a positive voltage will be applied into conduction and will remain in conduction until the forward voltage is removed or the gate 86 is reversed as the detector is disabled. The microprocessor 100 will monitor the emitting code 8, 9 and activate the SCR 85 to control the detectors 10 simultaneously. This microprocessor 100 will perform specific functions of home security, and will also receive signals 8, 9 from the electronic smoke detectors 20 in the home 5 and send said signals 8, 9 to other devices like the reporter 50 to report the activity to the appropriate authorities 35. The PIR 15 will send out signals and then it will analyze the signal that is reflected back by the objects in the home 5. It will then discriminate against random motion that is created by winds or by a heating and cooling system.

A group of semiconductor devices or Thyristors act as open or closed switches when a detector 10 is activated. When the detectors 10 are disabled, the Thyristor is positioned as an open circuit. And when the detector 10 is enabled, the Thyristor is positioned as a closed circuit and the radiant energy is emitted. The Thyristor is the controller that tells the passive infrared motion detectors 15 and other detectors 10 where the emitting signal is coming from, so it can differentiate an intruder code from a fire code.

The controller 85 will receive all instructions from the microprocessor 100. This controller 85 is preferably a silicon-controlled rectifier (SCR). When the detector 20 is in its normal state, the silicon-controlled rectifier 85 will block any applied voltage in either direction. When a motion is sensed or the PIR 15 is activated, the silicon-controlled rectifier 35 will conduct voltage in the forward direction as the appropriate signal from the detectors 10, 15 is applied to its gate electrode 86.

The silicon-controlled rectifier 85 has the positive lead of the voltage source connected to the anode 87 and the negative lead connected to the cathode 88. Junction one 92 and junction three 93 are forward biased and junction two 94 is reversed biased. The gate 86 is the control point for the silicon-controlled rectifier 85. The reverse bias does not conduct and the forward bias will not conduct at its normal state, since one of the diode junctions will be reversed biased.

However, the forward biased silicon controlled rectifier 85 will conduct if a voltage or current pulse is applied to the gate 86 in the direction to the forward bias junction two 94. Once the silicon-controlled rectifier 85 is activated, the gate 86 signal will then be of no consequence. That is, the circuit will continue to conduct regardless of the presence or lack of the gate 86 signal until the forward current drops below a certain level, which is indicative of no body heat 25.

The silicon-controlled rectifier 85 can also be made to conduct without a signal to the gate 86. In this embodiment, the device will block current up to the point that is the forward break-over voltage. At this point the silicon-controlled rectifier 85 will break down and conduct even without a gate 86 signal.

Figure 5:
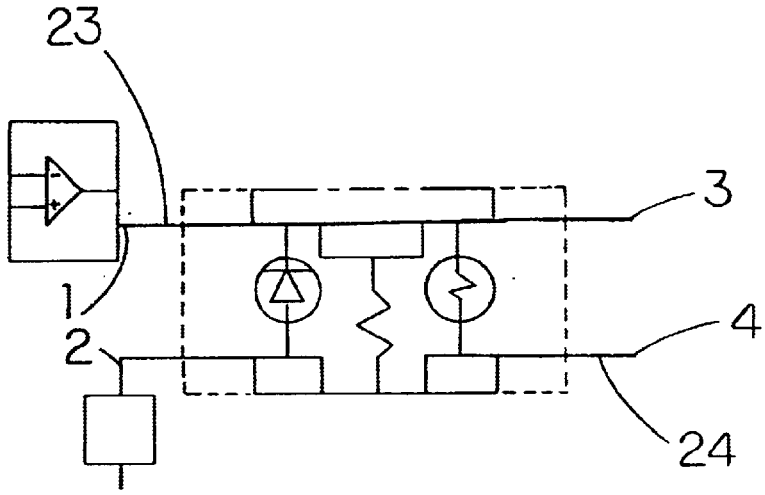
FIG. 5 is a diagram showing the photocell and LED for descriptive picturing of a human body within the home during actuation of an alarm in an emergency.
Figure 6:
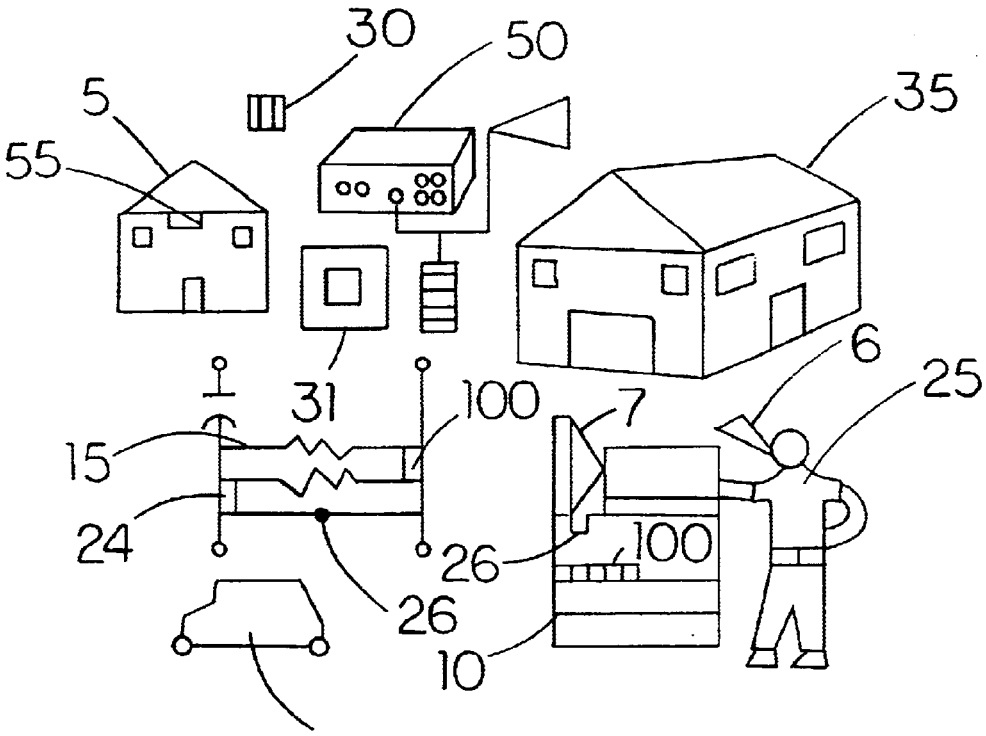
FIG. 6 is a diagram of the interactive wireless home security detectors located about a home, including the microprocessor, the reporter, and a touch pad.
Figure 7:
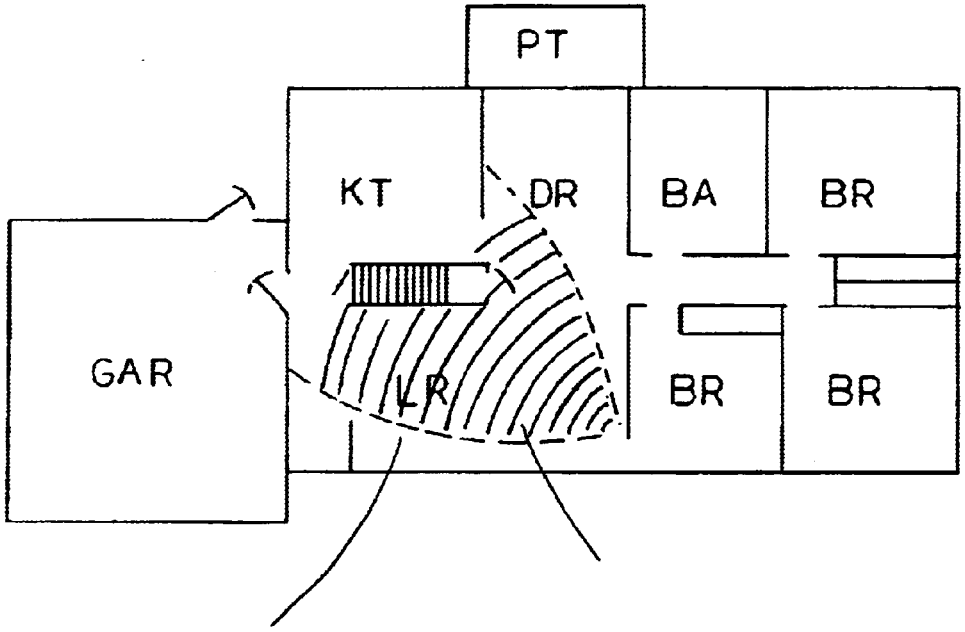
FIG. 7 is a diagram of the interactive wireless home security detectors located within a room in a home.
Figure 8:
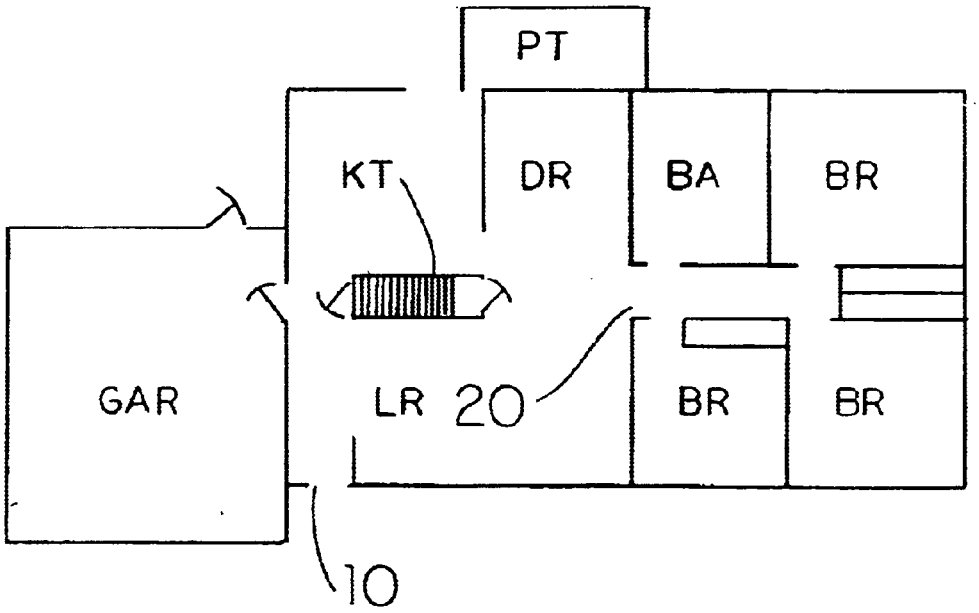
FIG. 8 is a diagram of the interactive wireless home security detectors showing perimeter protection.

As shown in FIG. 5, the silicon-controlled rectifier 85 switch S1 is open when the silicon-controlled rectifier 85 does not conduct or the detector is in the normal mode and the passive infrared motion detector is disabled. When Si is momentarily closed, a positive voltage is applied into conduction and will remain in conduction until the forward voltage is removed or the gate 86 is reversed as the enabled detector is disabled.

This silicon-controlled rectifier 85 has two diodes that are formed back to back. The current ranges in milli-amperes. The transistors are also incorporated in this device to amplify signals to the desired frequencies. The advantage of the incorporated transistor is the low operational power, no warm ups necessary, cool operation, low operational voltage and very small physical size. The transistor will also withstand excessive vibration and shock, and are very inexpensive.

The transistor is designed to accept changes in ambient temperature. The transistor is connected so that the emitter is common to the input and output circuits of the infrared motion detector 15 to receive and transmit different signals. The input signal is applied across the EB junction and the output signal is taken from across the CE output circuit. It measures the static collector characteristics of the transistorized code from the burglary or fire alarm 7. The passive detectors do not require an operating voltage to function. They require resistors, capacitors, and diodes. The interactive detectors 10 require an operating voltage to function, like transistors.

The narrow band should have a smaller receiver 45 band width to avoid interference while the receiver 45 processes the signals received by the antenna 79 and regenerate the digital messages of the transmitter 40. For the spread spectrum, the transmitter 40 will communicate across wide band of choices on the radio spectrum. Preferably, the same data will be transmitted over many different frequencies at the same time.

The invention is fully described by means of the specific embodiment. It is further to be understood that the present invention is not limited to the sole embodiment described thereto, but encompasses any and further development within the scope of the following claims.

What is claimed is:

1. An interactive wireless home security detector apparatus, comprising:

a) a first set of interactive detectors, each of the first set of interactive detectors being selected to detect at least one of smoke, fire, head, and freezing temperature, and a second set of interactive detectors, each of the second set of interactive detectors being selected to detect at least one of selected sounds, motion, and unauthorized entry;

b) at least one human body sensor for detecting the location of a human body within a home, each human body sensor having a transmitting and receiving means for enabling networking and wireless communication signals with the first set and the second set of interactive detectors;

c) at least one alarm, for signaling actuation of at least one of the first set and the second set of interactive detectors, and for signaling actuation of at least one human body sensor for indicating the presence of a human body within the home upon actuation of at least one of the first set and second set of interactive detectors;

d) at least one transmitter for transmitting a coded signal from at least one of the first set and second set of interactive detectors;

e) at least one receiver, for receiving the coded signal from the transmitter;

f) a programmable microprocessor for receiving, storing and processing data from the receiver; and g) a programmable reporter for inputting programming from the programmable microprocessor to the first set and second set of interactive detectors, and for selectively reporting sensed alarm activities to selected proper authorities in the presence of an emergency detected by at least one of the first set and the second set of interactive detectors, to initiate a rescue.

2. The interactive wireless home security detector apparatus of claim 1, wherein the at least one human body sensor is a temperature sensing means, each human body sensor located in selected areas within a home, for monitoring the location of a human body in a home in the presence of an emergency, and for tracking movement of a human body within the home, and for continuously signaling the location of the human body with the home in the presence of the emergency.

3. The interactive wireless home security detector apparatus of claim 1, wherein the at least one alarm is a plurality of alarms, each alarm located in selected areas within a home, for signaling the presence and location of the emergency, and said alarms adapted to emit coded signals readable by a plurality of sensors, the plurality of sensors being in wireless communication with the first set and the second set of interactive detectors, and the human body sensors.

4. The interactive wireless home security detector apparatus of claim 1, wherein the second set of interactive detectors includes at least one image recorder to record and store the image of the human body within the home, in the presence of an alarm signal.

5. The interactive wireless home security detector apparatus of claim 1, wherein the programmable reporter selectively reports sensed alarm activities to selected proper authorities by at least one of: wireless communication and existing telephone lines, and the proper authorities are selected from at least one of a police department, a fire department, and a remote home security monitoring station.

6. The interactive wireless home security detector apparatus of claim 5, wherein the wireless communication is transmitted by at least one of: radio waves, microwaves and ultrasonic waves.

7. The interactive wireless home security detector apparatus of claim 1, wherein the coded signals from the first set and the second set of interactive detectors are unique to each interactive detector, and the programmable microprocessor stores the location and type of detector relating to each unique coded signal, and reports the location and type of detector to the reporter upon actuation of at least one alarm signal in the presence of an emergency.

8. The interactive wireless home security detector apparatus of claim 7, wherein the coded signal is modulated prior to transmission, and further includes a human voice message responsive to the address of the home, the nature of the alarm signal, and the presence of a human body with the home during the emergency.

9. The interactive wireless home security detector apparatus of claim 1, wherein the first set of interactive detectors include at least one of: a heat detector, an ionization smoke detector and a photoelectric smoke detector.

10. The interactive wireless home security detector apparatus of claim 1, wherein an antenna is used to transmit coded signals to a remote location, and the antenna is one of a redundant antenna and a diverse antenna, to reduce the likelihood of a false signal.

11. The interactive wireless home security detector apparatus of claim 1 wherein transistors are incorporated into the interactive detectors to amplify signals from the interactive detectors to a desired frequency suitable for transmission, which provides no warm up, cool operation, low operational voltage and small physical size.

12. An interactive wireless home security detector apparatus, comprising:

a) a first plurality of interactive detectors, each of the first plurality of interactive detectors being selected to detect at least one of smoke, fire, heat, and freezing temperatures, and a second plurality of interactive detectors, each of the second plurality of interactive detectors being selected to detect at least one of selected sounds, motion, and unauthorized entry;

b) a plurality of human body temperatures sensors, each human body temperature sensor having a transmitting and receiving means for enabling networking and wireless communication signals with the first and second plurality of interactive detectors, each human body temperature sensor for monitoring the presence and location of a human body in a home in the presence of an emergency, and for continuously signaling the location of the human body within the home in the presence of the emergency;

c) a plurality of alarms, each said alarm emits a coded signal readable by a plurality of sensors, the plurality of sensors being in wireless communication with the first and second plurality of interactive detectors, each alarm being positioned within a selected area of the home, for signaling actuation of at least one of the first plurality of interactive detectors and for signaling actuation of at least one of the second plurality of interactive detectors, and for signaling actuation of at least one human body temperature sensor in the presence of an alarm, and for indicating the location and presence of a human body within the home;

d) a plurality of transmitters, each transmitter for transmitting a coded signal from one of the first and second plurality of interactive detectors;

e) at least one receiver for receiving the coded signal from at least one of the first and second plurality of transmitter;

f) at least one microprocessor for receiving, storing and processing data from the receiver; and g) at least one reporter for inputting programming from the microprocessor to the plurality of interactive detectors, and for selectively reporting a sensed alarm condition to at least one of the police department and the fire department in the presence of an emergency, said reporting of a sensed alarm sent by at least one of: wireless communication and existing telephone lines, to initiate a rescue.

13. The interactive wireless home security detector apparatus of claim 12, wherein the wireless communication is transmitted by at least one of: radio waves, microwaves and ultrasonic waves.

14. The interactive wireless home security detector apparatus of claim 12, wherein the coded signals from the interactive detectors are unique to each interactive detector, and the programmable microprocessor stores the location and type of interactive detector relating to each unique coded signal, and reports the location and type of the interactive detector to the reporter upon actuation of the interactive detector in the presence of an emergency.

15. The interactive wireless home security detector apparatus of claim 12, wherein the second set of interactive detectors includes at least one image recorder to record and store the image of the human body within the home, and to transmit the recorded image to the proper authorities, in the presence of an alarm signal.

16. The interactive wireless home security detector apparatus of claim 12, wherein the interactive detectors include at least one of: a heat detector, an ionization smoke detector and a photoelectric smoke detector.

17. The interactive wireless home security detector apparatus of claim 12, wherein an antenna is one of: a redundant antenna and a diverse antenna, and said antenna is used to transmit coded signals to a remote location.

18. The interactive wireless home security detector apparatus of claim 12, wherein the encoded signal is modulated prior to transmission, and further includes a human voice message responsive to the location of the home, the nature of the alarm signal, and the presence or absence of a human body within the home at the time of the emergency.

19. An interactive wireless home security detector apparatus, comprising:

a) a first plurality of interactive detectors, each of the first plurality of interactive detectors being selected to detect at least one of smoke, fire, heat, smoke, and freezing temperatures, and a second plurality of interactive detectors being selected to detect at least one of selected sounds, motion, and unauthorized entry, a coded signal from each of the first interactive detectors and the second interactive detectors being unique to each interactive detector, and a programmable microprocessor for storing the location and type of interactive detector relating to each unique coded signal, and reporting the location and type of interactive detector to a reporter upon actuation of one or more of the interactive detectors in the presence of an emergency;

b) a plurality of human body temperature sensors, each human body temperatures sensor having a transmitting and receiving means for enabling networking and wireless communication signals with a plurality of interactive detectors, each human body temperature sensor for monitoring the presence and location of a human body in a home in the presence of an emergency, and for continuously signaling the location of the human body within the home in the presence of the emergency;

c) a plurality of alarms, each said alarm emitting a coded signal readable by a plurality of sensors, said plurality of sensors being in wireless communication with the first and second plurality of interactive detectors, each alarm being positioned within a selected area of the home, for signaling actuation of at least one interactive detector, and for signaling actuation of at least one human body temperature sensor for indicating the location and presence of a human body within the home;

d) at least one image recorder to record and store the image of the human body within the home, in the presence of an alarm signal;

e) a plurality of transmitters, each transmitter for transmitting a coded signal from one of the plurality of interactive detectors;

f) at least one receiver for receiving the coded signal from one of the plurality of transmitters;

g) at least one microprocessor for receiving, storing and processing data from the receiver;

h) at least one reporter for inputting programming from the microprocessor to the first and second plurality of interactive detectors, and for selectively reporting a sensed alarm condition to a least one of: the police department and the fire department in the presence of an emergency, said reporting of a sensed alarm sent by wireless communication selected from at least one of: radio waves, microwaves and ultrasonic waves, to initiate a rescue; and i) an antenna is used to transmit coded signals to a remote location.

20. The interactive wireless home security detector apparatus of claim 19, wherein the encoded signal is modulated prior to transmission, and further includes a human voice message responsive to the location o the home, the natures of the alarm signal, and the presence or absence of a human body within the home during the emergency.

* * * * *